United States Patent [19]

Ficho

[11] Patent Number: 4,880,377

[45] Date of Patent: Nov. 14, 1989

[54] CIGARETTE LIGHTER WITH CHARM MOUNTED THEREON

[75] Inventor: William Ficho, Lincolnwood, Ill.

[73] Assignee: Vasilia, Ltd., Chicago, Ill.

[21] Appl. No.: 666,145

[22] Filed: Nov. 1, 1984

Related U.S. Application Data

[63] Continuation of Ser. No. 472,647, Mar. 11, 1983, abandoned, which is a continuation-in-part of Ser. No. 373,881, May 3, 1982, abandoned.

[51] Int. Cl.[4] ..... F23Q 2/32

[52] U.S. Cl. ..... 431/126; 431/152; D27/141; D27/149

[58] Field of Search ..... 431/126, 151, 152; D27/36, 39, 40, 41, 141, 149; 206/457

[56] References Cited

U.S. PATENT DOCUMENTS

| | | | |
|---|---|---|---|
| D. 82,647 | 11/1930 | Florman | D27/41 |
| D. 82,647 | 9/1930 | Florman . | |
| D. 138,098 | 6/1944 | Negbaur | D27/40 |
| D. 144,125 | 3/1946 | Monturo | D27/38 |
| D. 155,565 | 10/1949 | Adler et al. | D27/39 |
| D. 164,745 | 10/1951 | Treiss | D27/39 |
| D. 212,898 | 12/1968 | Stephens | D27/39 |
| 1,652,775 | 12/1927 | Funk et al. | 428/31 |
| 1,760,933 | 6/1930 | Aronson | 431/126 |
| 1,804,279 | 5/1931 | Schnell et al. | 428/31 |
| 2,032,273 | 2/1936 | Florman | 431/126 |
| 2,329,046 | 9/1943 | Halbig | 428/31 |
| 2,728,211 | 12/1955 | Mihan | 431/125 |
| 2,803,123 | 8/1957 | Owen | 431/152 |
| 3,001,307 | 9/1961 | Sieve | 431/126 |
| 3,092,119 | 6/1963 | Gold et al. | 431/126 |
| 3,148,856 | 9/1964 | Orlando | 428/31 |
| 3,618,279 | 10/1971 | Schenke | 431/126 |
| 3,895,903 | 7/1975 | Lefebvre | 431/143 |
| 4,073,612 | 2/1978 | Nitta | 431/126 |
| 4,240,783 | 12/1980 | Nevin et al. | 431/126 |
| 4,330,954 | 5/1982 | Lonsmin | 431/126 |

FOREIGN PATENT DOCUMENTS 2410323 6/1979 France .

*Primary Examiner*—Randall L. Green

*Attorney, Agent, or Firm*—Laff, Whitesel, Conte & Saret

[57] ABSTRACT

An upstanding charm is mounted on the top panel of a cigarette lighter, of the type wherein all working mechanical parts are completely contained within a simple unadorned box. The box has a flip top, which opens when the lighter is used, and thereafter closes to extinguish the flame. The invention is particularly directed to display, in an interesting manner, a charm mounted on the lighter while it is held in a hand during normal usage, when the flip top is both opened and closed. The invention also provides for an adornment of other types of lighters and for changing the charm to fit the style, circumstances, and mood of usage.

4 Claims, 8 Drawing Sheets

CIGARETTE LIGHTER WITH CHARM MOUNTED THEREON

This is a continuation of application Ser. No. 472,647, filed Mar. 11, 1983, now abandoned, which was, in turn, a continuation-in-part of Ser. No. 373,881, filed May 3, 1982, now abandoned.

This invention relates to personal accessory items and more particularly to an ornamentation of accessories (such as cigarette lighters) usually carried in pocket or purse.

The term "charm" is herein intended as broadly including almost any ornamental statuary thing or simulation thereof, which may be depicted in such a small size that it would be interesting to wear or view. A "charm" is a three dimensional object (often made of gold or silver) usually produced by sculpturing, modeling, or casting, which is generally carried or worn on the person, for personal adornment. A charm may be in the shape and proportions of almost anything which can be imagined, such as statues, animals, models of buildings, tools, sports figures, or the like.

Personal accessory items are usually functional items which are carried primarily for a utilitarian purpose, such as combs, lipstick, compacts, lighters, and the like. On the other hand, jewelry is usually displayed as personal adornment to convey information or images which the wearer considers important, such as a status symbol, membership in an organization, or the like. The personal accessory item is generally out of sight in pocket or purse while jewelry is primarily worn to be seen by others.

New and acceptable means for and methods of conveying personal information is especially valuable to men, although women will also find such means and methods to be of value. Generally, women are free to wear jewelry or any other item of personal adornment in almost any manner which can be imagined. However, most men feel constrained to restrict themselves to rings, lapel pins, or the like. Thus, a woman may express her femininity by wearing anything from flowers through jewelry. However, there is no easy way for a man to exhibit masculinity, without simultaneously appearing ostentatious or, perhaps, even feminine. Hence, there is a need for a non-jewelry display of symbols by which one may express a personality. One person may wish to be seen with macho symbols, another with feminine symbols, another with professional identification, and still another with symbols of sports, zodiac, or the like. Still other reasons for a use and display of such symbols will readily occur to those who are skilled in such art.

Since the personal accessory may include a significant work of art which is too beautiful to rest unseen, it is desirable to also be able to display it as a table or desk ornament, or the like. Accordingly, there is a need for means for quickly and easily converting it between an accessory to be carried in pocket or purse and an accessory to stand upon a table, desk, or the like. Moreoever, this conversion means should enhance——rather than detract from——the basic appearance of the art work.

Accordingly, an object of the invention is to provide new and novel means for and methods of displaying personal ornaments, in a non-jewelry format which is equally attractive to both men and women. In this connection, an object is to provide for personality expression, which is especially well——although not exclusively——suited to men. Here, an object is to provide personal accessories, and particularly cigarette lighters, which display charms.

In keeping with an aspect of the invention, these and other objects are accomplished by mounting charms on cigarette lighters, and especially on the tops of lighters of the type wherein all mechanical working parts are completely contained within a simple and normally unadorned box. The box has a flip top, which opens before the lighter is used, and thereafter closes to extinguish the flame. The invention is particularly directed to a display of a charm mounted on the box in a manner so that it is seen while the lighter is held in a hand during normal usage, regardless of whether the flip top is opened or closed. The invention also provides for the adornment of other types of lighters and further provides for changing the ornamentations to fit the styles, circumstances, and moods at the time of usage. A further flexibility is provided by a separate stand which holds the lighter and charm in an upright position for table or desk display. A pan shaped insert is constructed in the stand so that it may be shaped by a simple hand operation (or punch press) to cause the lighter to stand in a vertical position, regardless of any minor misalignments which might originally appear during manufacture.

Several embodiments of the invention are shown in the attached drawing, wherein.

Figure 1:
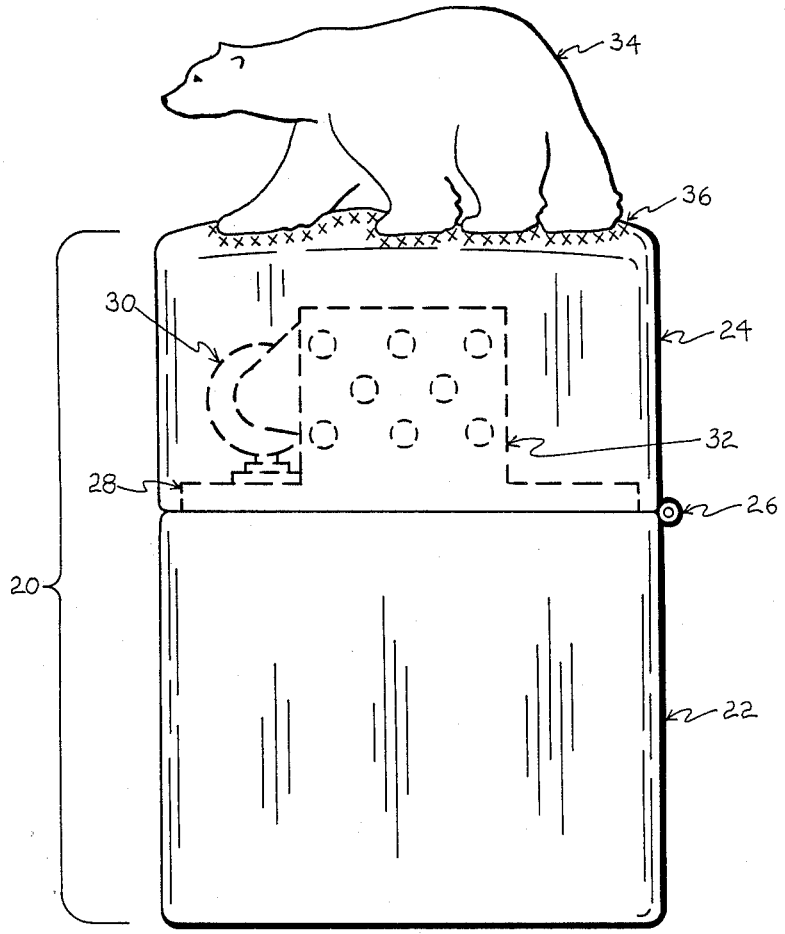
FIG. 1 is a side elevation of a charm mounted entirely on the top of a lighter, of the flip-top box design.

The lighter 20 (best seen in FIG. 1) comprises a simple and unadorned box having a bottom 22 with a flip top 24 attached thereto by a hinge 26. Completely enclosed within the box is a removable insert 28 which has a flint wheel 30, a wind-screen-chimney 32, and a wick (not shown). Usually, the closed lighter is held by the bottom 22 with the user's fingers curled around it, in a somewhat loose fist, with the top 24 extending above the fist. To use the lighter, the thumb of the same hand is usually used to flip back the top 24 and then to turn the flint wheel 30. To extinguish the lighter, the top 24 is flipped back over the top, usually by the index finger.

As the lighter is so used, the top 24 is visible at the top of the fist, both when the lighter top is closed and when it is standing open. Thus, the top is a place, which is completely visible at all times, where a charm, symbol or image may be seen.

In the embodiment of FIG. 1, the charm 34 is in the form of a free standing bear, completely supported on the top surface of the lighter. The charm 34 is permanently attached, at 36, to the lighter by any suitable bonding means such as an adhesive, spot welding, brazing, or soldering. In one embodiment which was actually built and tested, both the lighter 20 and the charm 34 were made of sterling silver, and the attachment at 36 was made by silver brazing. An epoxy cement also provides good adhesion.

One consideration which leads to a selection of the charm design and of the mode of charm attachments centers on whether the attachment is to be made in a factory or at a point of purchase. If the attachment is made in a factory, the bonding by brazing, welding, soldering, cementing, (as by a use of epoxy, for example), etc. of FIG. 1 is probably preferred. However, if the attachment is to be made at the point of purchase, a substantially foolproof and easier to use mode of attachment is desired. A clerk in a department or drug store, for example, does not normally have either the skill or the equipment to weld, braze or solder. The customer does not usually have enough time to wait for epoxy to cure and harden. Also, if the charms are mounted in a store environment, it seems likely that it may be put on crooked, off center, or the like, unless there is a means for insuring a correct alignment.

Accordingly, except for the embodiment of FIG. 1, each of the embodiments, shown and described herein, provides a charm having a pocket which embraces and nests around the lighter. Therefore, if the lighter is fitted into the nesting embrace of the pocket, it must be properly positioned, in a good visual alignment.

Figure 3:
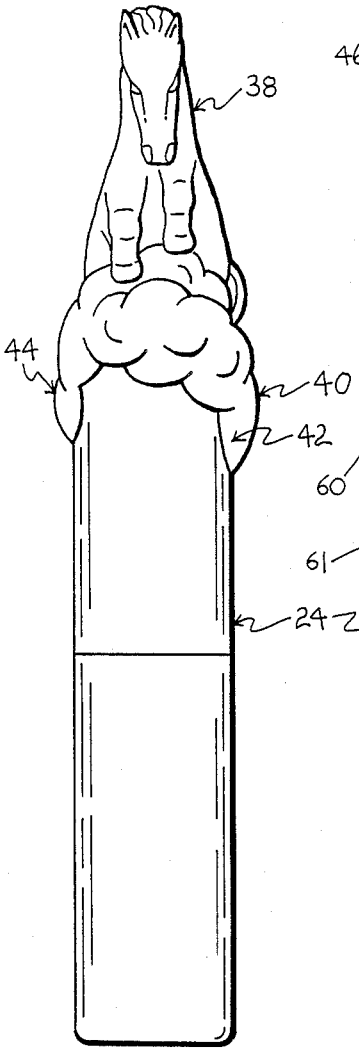
FIG. 3 is a front elevation view of the embodiment of FIG. 2 showing how the charm embraces the lighter to enhance mechanical strength and stability.
Figure 2:
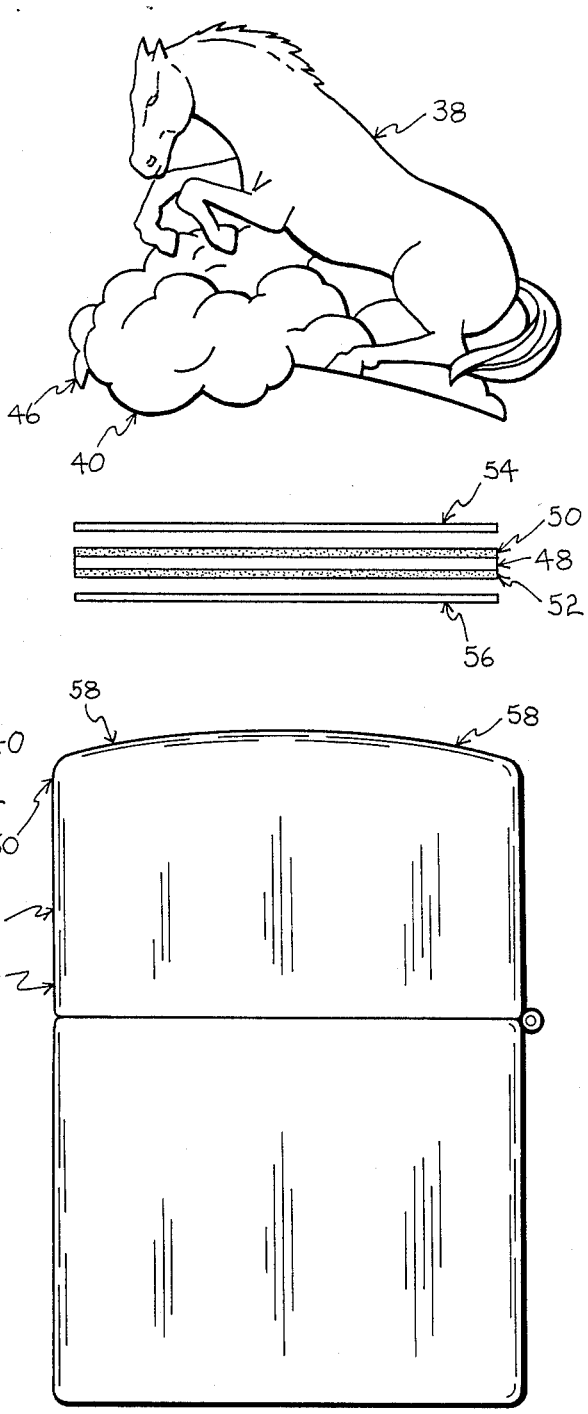
FIG. 2 is an exploded view of a charm mounted on a lighter by a use of double sided adhesive tape.

For example, in the embodiment of FIG. 2, the charm 38 is a horse, pawing-up a cloud of dust 40, which is hollow to form the pocket. More particularly, as seen in FIG. 3, the cloud 40 of dust drapes down and around the upper edge of the lighter's flip-top 24, to give a mechanical alignment. On at least one side 42, the dust cloud 40 extends downwardly far enough to give a substantial vertical stability to the charm. The cloud 40 also extends downwardly at 44 on the opposite side of the lighter and at 46 over an end of lighter top to complete the pocket. As is apparent from an inspection of the drawings, the pockets in the various figures hug one end of the top and surround approximately 40–60% of the perimeter thereof.

A double sided, piece of soft sponge-like tape material 48 has a pressure sensitive adhesive 50, 52 distributed on its opposite sides, with release papers 54, 56 covering the adhesive. To install the charm, the lower release paper 56 is peeled away, and the layer 48 is stuck (by adhesive 52) to the upper surface 58 on the top 24 of the lighter. Next, release paper 54 is peeled away. Then, the pocket which is formed by the cloud of dust 40 is fitted over the upper front edge 60 of the lighter, with the front 46 of the cloud in close engagement with the front side 61 of the lighter. With a rocking motion, the charm 38 is brought down and into firm contact with the upper layer of adhesive 50.

Figure 4:
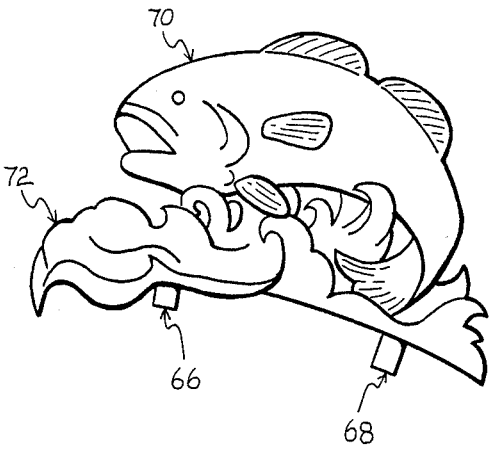
FIG. 4 is an exploded view (partially in cross section) showing an embodiment using a dependent attaching member, such as a rivet or screw, for example.
Figure 4:
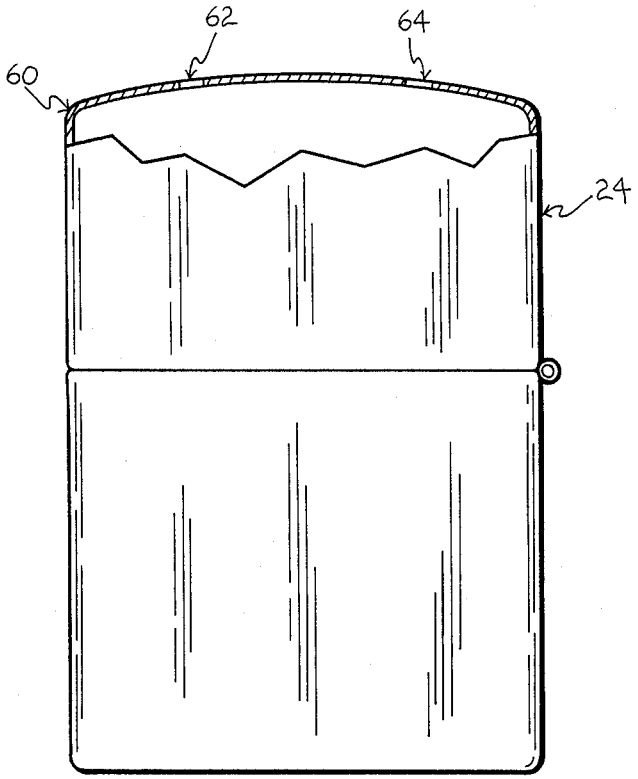
Figure 5:
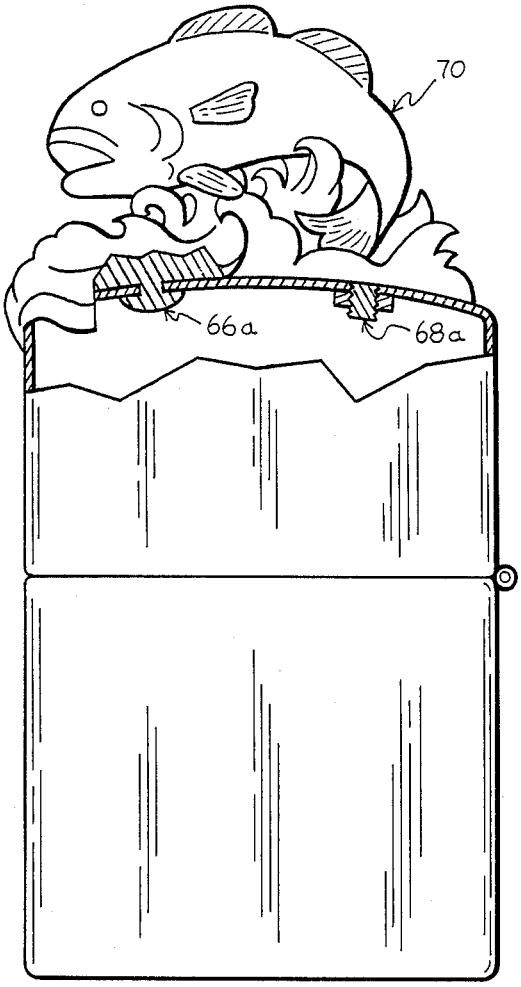
FIG. 5 is a side elevation, partially cut away, to show the manner of attachment of the charm of FIG. 4.
Figure 6:
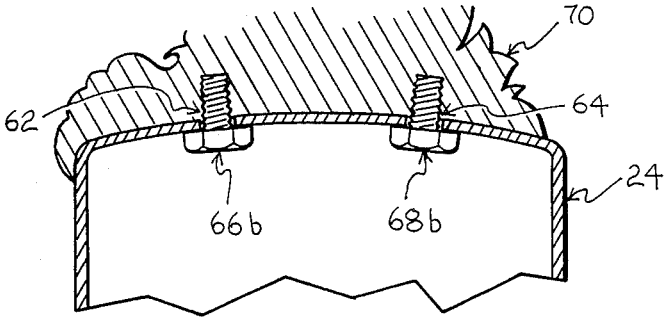
FIG. 6 is a fragmentary view (similar to FIG. 5) in which threaded screws are used to make the attachment.

In the embodiment of FIGS. 4–6, the wave 72 forms a pocket for receiving the corner 60 of the lighter, and for extending downwardly on opposite sides of the lighter far enough to give vertical stability to the charm.

The lighter top 24 has pre-drilled holes 62, 64, accurately positioned to receive dependent fasteners 66, 68 integrally formed on charm 70. The charm is placed over the top 24 with the facteners 66, 68 passing through the holes 62, 64. The dependent fasteners 66, 68 may have any convenient form. For example, as seen at 66*a* (FIG. 5), they may be rivets which are secured in place by any suitable swaging tool, such as a small press. Or, as shown at 68*a*, the fastener may be a threaded screw which receives a nut, for bolting the charm in place. In FIG. 6, the fasteners 66*b*, 68*b* are threaded bolts which fit inside the top 24, through the holes 62, 64, and into holes which are drilled and tapped into the bottom of the charm 70. The nuts (as at 68*a*——FIG. 5) or the bolts (as at 66*b*, 68*b*——FIG. 6) may be tightened with a conventional nut driver.

Figure 7:
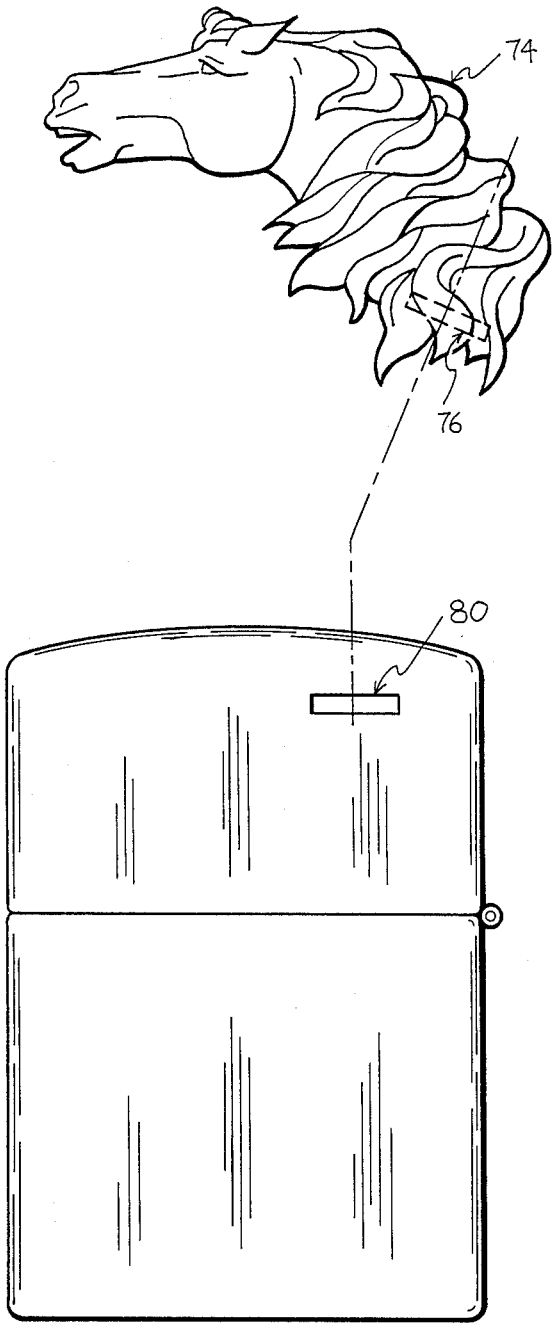
FIG. 7 is an exploded side elevation view of a snap-on charm.
Figure 8:
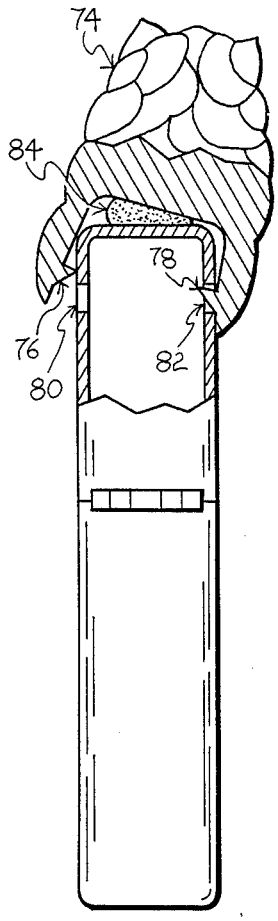
FIG. 8 is an end elevation (partially in cross-section) showing the charm of FIG. 7 as it is being snapped into position.

In the embodiment of FIGS. 7, 8, the charm 74 is made with inwardly directed snap tabs 76, 78, in a spaced, opposed relationship. By simply pushing the charm over the top of the lighter, the inclined surface on the bottoms of the tabs spread them sideways, until they drop into keeper holes 80, 82 where they snap into place. For many users, this would be all that is required. However, the charm might be a little loose and that may be undesirable for some people. Therefore, either a double sided adhesive strip or cement such as epoxy may be placed in the area 84 of contact between the charm and the lighter. Another approach is to use a swaging tool inside the lighter top to crimp the tabs 76, 78 and thereby securely hold the charm in place.

The embodiments described thus far have means for permanently mounting a charm on the top of a lighter. It is also possible that someone may wish to have replaceable charms which may be changed, at will, much as cuff links or earrings are changed to fit the mood and style of an occasion. Thus, for example, someone wearing a black evening dress might want to have a silver charm, which becomes a highlight of personal adornment. At another time, the same person might be wearing a white evening dress, in which case, the silver would not show up, and a black charm would be more appropriate.

Figure 9:
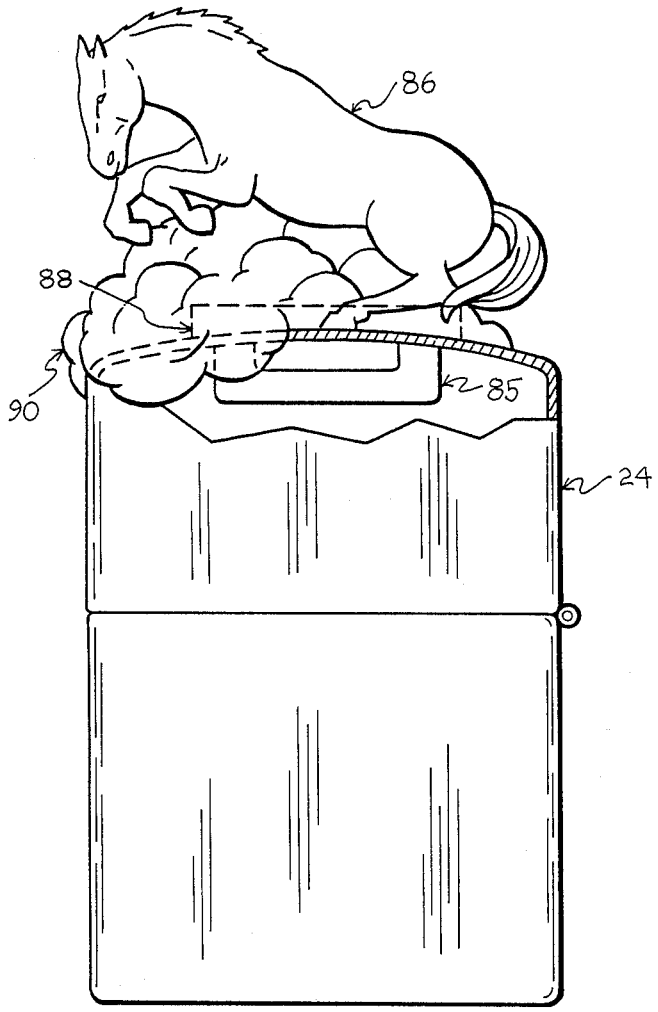
FIG. 9 is a side elevation, partially in cross section of a replaceable charm held in position by a permanent magnet.

For this replaceable charm, affixed inside the lighter top 24 (FIG. 9) is a permanent magnet 85, which should be made of a relatively powerful magnetic material, such as Alnico V.. The charm 86 contains a keeper bar of metal 88 which is attracted by magnet 85. Again, the pocket in the cloud of dust 90 fits over the upper edge of the lighter to stabilize the position of the charm. The top 24 of the lighter is made from a non-magnetic material which prevents the formation of a shunt so that all of the magnetic flux goes through keeper bar 88. Thus, to replace the charm 86, it is only necessary to slide it to the left (as viewed in FIG. 9) and off the top.

Figure 10:
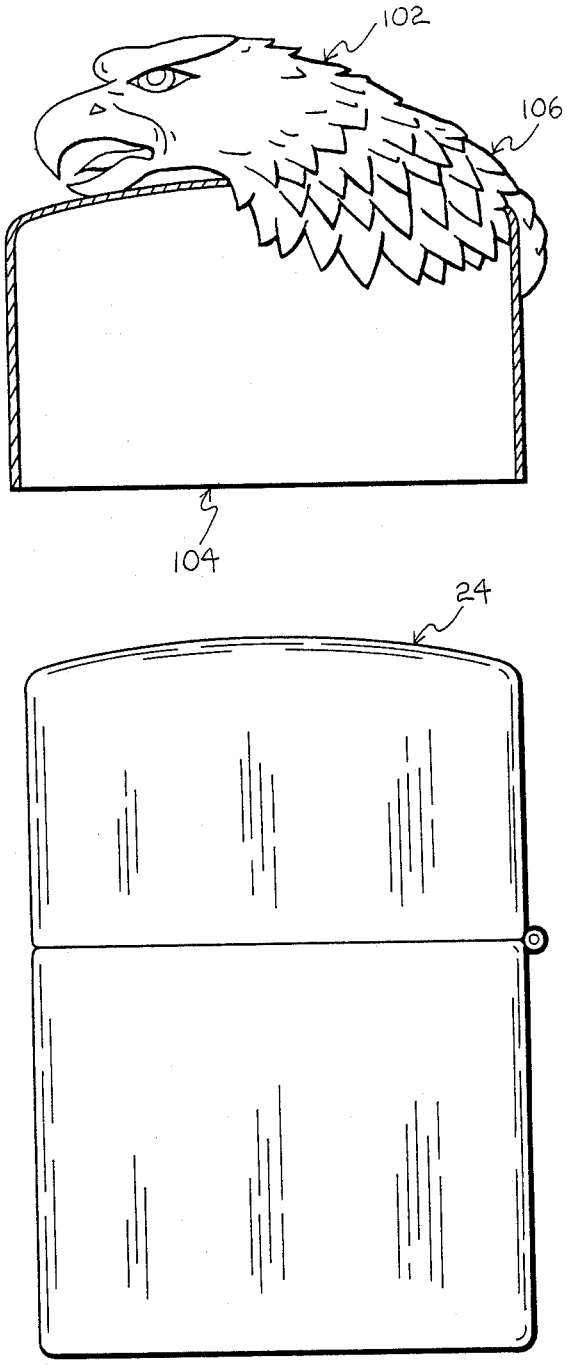
FIG. 10 is a side elevation (partially in cross section) of a charm mounted on a replaceable sleeve.
Figure 11:
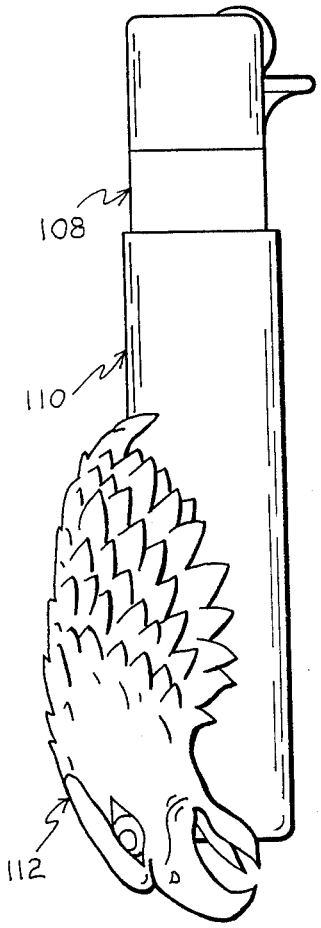
FIG. 11 is a side elevation of the charm-sleeve combination, used on a different type of lighter.

Another replaceable charm is seen in FIGS. 10 and 11. Here, the charm 102 is integrally formed on a sleeve 104, which slips over the top 24 of the lighter. If it becomes desirable to replace the charm, the sleeve 104 is slipped off and another similar sleeve is slipped on over the top 24. If a two piece charm and sleeve construction is used, the feathers 106 provide the nesting pocket and stabilizing support, which is described above.

If the embodiment of FIG. 10 is carefully designed, there are no under cut regions. Therefore, the sleeve and charm of FIG. 10 may be formed in a coin die, at a single stroke. A coin die is a well known device which contains a cavity which is enclosed within a mold. A pellet of metal may be dropped into a cavity and then a die may be lowered into the cavity and pressed against the pellet. As a high pressure is applied, the pellet of metal extrudes throughout into the desired shape (i.e., the integral charm 102 and sleeve 104).

The sleeve embodiment (FIG. 11) is particularly attractive when used with throw-away, butane lighters 108, which usually have a plastic body of a relatively small diameter and four or five inches long. A sterling silver or gold sleeve 110 with an attached charm 112 covers the plastic body and provides a more appropriate personal display in an environment where personal adornment is likely to be important. Again, the sleeve 110 enables a number of interchangable charms to be slipped on and off the lighter in order to match color schemes of clothing or the mood of the evening.

To enable any of the above described lighters 20 to be displayed as a table or desk ornament, a stand may be provided, as shown in FIGS. 12–16. The principle element of this stand is a cast or molded base 120 having suitably positioned feet 122 for giving stability to the vertical lighter, considering the geometry and distribution of the lighter mass and weight. The base may include art work in the area 124 which is coordinated with the art work of the charm 125 on top of the lighter 20. For example, a log fence corral might be an appropriate decoration on the sides of the base for the horse charm of FIGS. 2 and 3.

The base 120 is in the form of an open frame containing a window 126, which is slightly larger than the outside cross sectional dimensions of lighter 20. A pan 128 is made of relatively thin sheet metal and is stamped into a somewhat basin shaped well 130 which receives the base of lighter 20 snuggly enough to give vertical stability, but not snuggly enough to scratch the lighter or to make it difficult to insert or remove the lighter.

The upper edge of the basin terminates in a peripheral flange 132 which fits over the top edge 134 of the stand 120. The flange 132 of pan 128 may be secured to the top edge 134, by any suitable means, such as solder or epoxy cement. After the solder or cement hardens, the edge of flange 132 is dressed to fit the stand, and then the edge and stand are buffed. As a result, the pan 128 virtually disappears and appears to become an integral part of stand 120, where any joining at the edges 132, 134 is almost invisible.

The bottom of lighter 20 may now be slipped into the well 130, where the total appearance (FIG. 16) is one of a statuesque column with a sculpture on the top.

Figure 15:
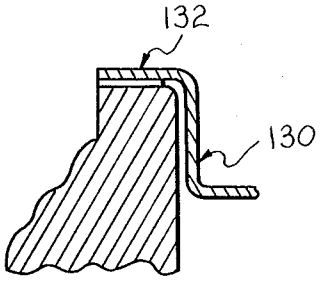
FIGS. 14 and 15 are two fragmentary views taken along line 14—14 of FIG. 13, showing how the straightening operation of FIG. 13 is accomplished.
Figure 14:
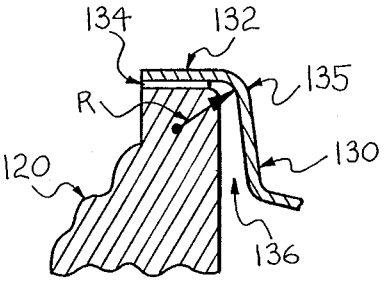
Figure 16:
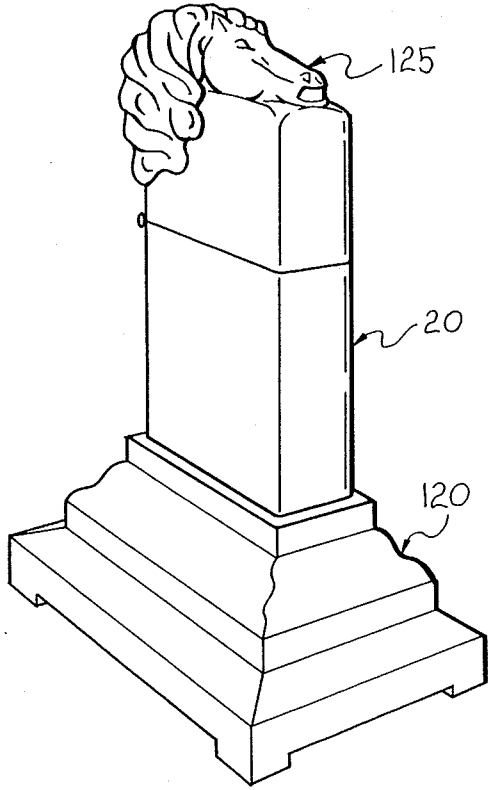
FIG. 16 is a perspective view of the inventive lighter and stand combination.
Figure 13:
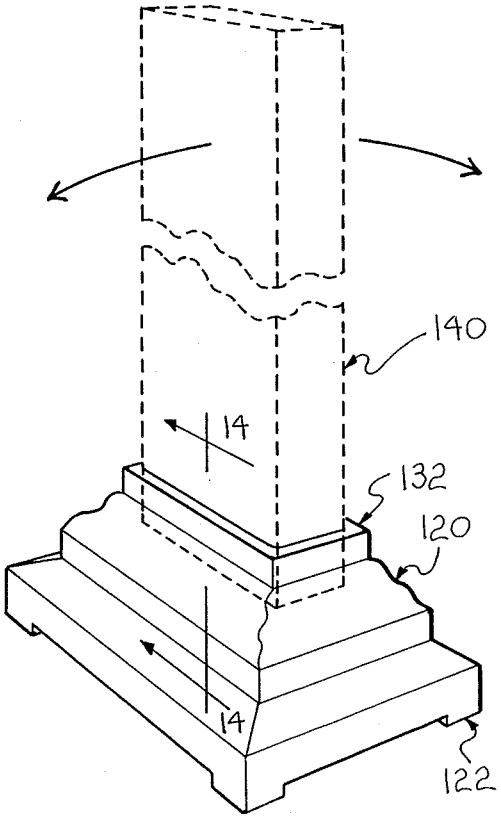
FIG. 13 is a perspective view which shows how a base in the stand is reshaped to cause the lighter to stand vertically, in case it should lean slightly after assembly.
Figure 12:
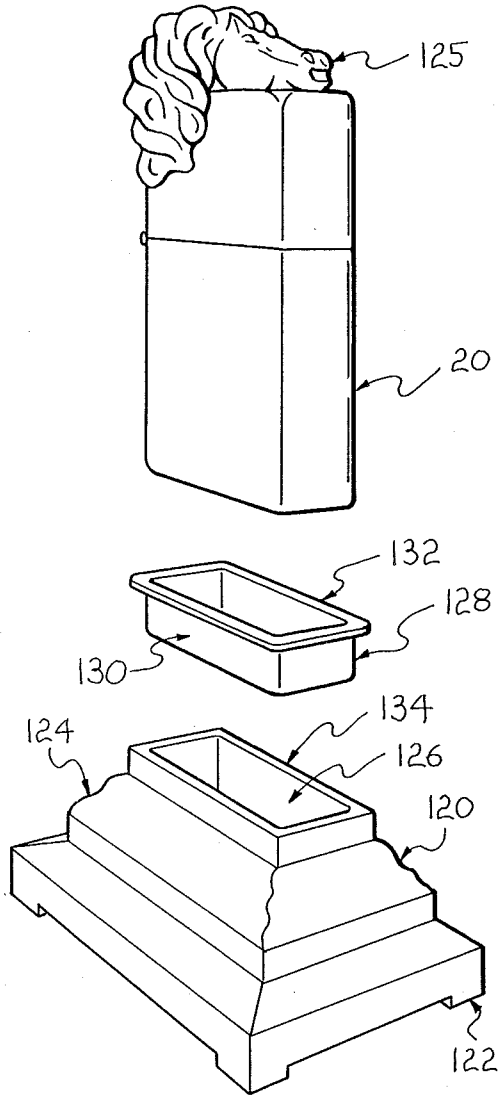
FIG. 12 is an exploded view of a lighter and stand which are used to convert the pocket ornament into a table or desk display of the same ornament.

As seen in FIGS. 14, 15 the pan 128 has a rolled edge 135 with a radius R which is large enough to provide some relief in area 136 between the stand 120 and the basin 130. Thus, there is room enough to force the basin 130 to move toward or away from the stand at any given location. Therefore, if the lighter appears to lean, the stand is placed on a horizontal surface. Next, a hand operated post 140 is placed in the basin. The cross section of the basin 132 exactly fits over the bottom of the post 140. Then, the post 140 is pulled in an appropriate direction to reshape the basin 130 slightly and to cause the lighter to stand vertically when feet 122 rest on a horizontal plane. The length of post 140 is adequate to enable vertical trueness from a visual inspection. As shown in FIG. 15, the basin 130 is moved slightly. However, the relief at 136 enables the basin to move toward or away from the stand to provide a more perfectly aligned vertical position (as seen in FIG. 15).

Those who are skilled in the art will readily perceive how to modify the invention. Therefore, the appended claims are to be construed to cover all equivalent structures which fall within the true scope and spirit of the invention.

I claim:

1. A personal accessory to be carried about on the person of the user, said accessory comprising a plain and unadorned generally rectangular box, said box being divided into a bottom section and a flip top section, said flip top section having two stable positions, said flip top being hinged to one side of said box, the upper surface of said flip top being a simple and unadorned panel having edges defining a predetermined perimeter; a cigarette lighter including at least a flint wheel and a wick completely enclosed within the box when the flip top is in a first of said two positions with said box closed, the lighter and box being shaped and proportioned so that a user normally holds the bottom section of the box in his fist with his fingers curled around it with the flip top of the lighter extending above the fist, the second of said two positions being an open position, the flip top being completely visible above the fist in both said opened and closed positions with the flint wheel accessible to the thumb on said fist while holding said box, sculptured charm means mounted on the outside of said unadorned top panel of said box to stand above said fist and be visible when said top is in either of said two stable positions closed over said bottom or flipped to an open position, said charm being approximately aligned with and in front of the flame of said lighter insofar as the onlooker is concerned when the lighter is in use; an underside of said charm forming a somewhat cup shaped concave pocket having an unbroken surface which is closed on one side, said closed side of said pocket being fitted to follow, surround, and rest on said top panel, and to drape down and around at least part of the perimeter defined by one end and the adjacent edges of the upper surface of said flip top; said closed side of said pocket nesting against the one end of the top panel and extending over a side of the flip top of said lighter box downwardly far enough on at least one side of said lighter to give a vertical mechanical stability for attaching the charm to the flip top without interfering with the movement of the flip top between the two positions, and means for integrally attaching the closed side of said pocket on said charm to said top panel and to said one end at least one side of said flip top at a location where said pocket nests on and hugs said top.

2. A personal accessory to be carried about on the person of the user, said accessory comprising a plain and unadorned rectangular box having a bottom with a flip top having two stable positions hinged to one side thereof, the upper surface of said flip top being a simple and unadorned panel; a cigarette lighter completely enclosed within the box when the flip top is in a first of said two positions with said box closed, the lighter and box being shaped and proportioned so that a user normally holds the bottom of the box in his fist with his fingers curled around it with the top of the lighter extending above the fist, the second of said two positions being an opened position, the flip top being completely visible above the fist in both said opened and closed positions, and sculptured charm means mounted on the outside unadorned top panel of said box to stand above said fist and be visible when said top is in either of said two stable positions closed over said bottom or flipped to an open position, said charm being approximately aligned with and in front of the flame of said lighter insofar as the onlooker is concerned, when the lighter is in use, and a stand made of heavy metal having a design coordinated with the design of said sculptured charm, a relatively thin sheet metal pan means recessed into an opening in said heavy metal stand, an edge of said pan means being supported by said heavy metal stand, said pan means supporting the bottom part of said lighter to hold it in an upright and generally vertical position when said heavy metal stand is resting on a horizontal plane, said bottom part being a small fraction of the total height of the lighter, said pan having a thinness such that it is readily bendable while said heavy metal rests in said plane, said bending aligning the contours of said pan for supporting said lighter solely by its bottom part, whereby the major fraction of the total height of the lighter stands in a vertically aligned upright position.

3. A product for presenting a psychological prop in the form of personal accessories to be carried about by the user and having an impact upon the user's image, said product comprising:

(a) a six-sided box having a bottom and a flip top hinged thereto, the upper surface of said flip top being a simple and unadorned panel, the box being shaped and proportioned so that a user normally holds the bottom in his fist with his fingers curled around it and with the flip top of the box extending above the fist in a position where the top may be flipped open with a flick of the thumb;

(b) a cigarette lighter completely enclosed within the box, the top of the lighter being positioned to locate its flame approximately in a sight line between the face of the user and an onlooker, with the open flip top being completely visible above the fist; and (c) a sculptured charm mounted on the outside unadorned top panel of the flip fop of said box to stand above said top panel or be flipped to an open position, said charm being approximately in said line of sight and being aligned with an in front of the flame of said lighter insofar as the onlooker is concerned, when the lighter is in use, whereby the normal use of the lighter is to thrust a first carrying the image of the charm into the area of the face of a person getting a light from the lighter, (d) a stand comprising a base having an outside design which is coordinated with the design of said charm, and having a horizontally oriented window which is slightly larger than the outside cross section of said lighter;

(e) a pan comprising a basin of relatively thin sheet metal in said window for receiving the bottom of said lighter, said pan being terminated at its upper edge by a peripheral flange; and (f) said peripheral flange being attached to the top of said base at said window.

4. The product of claim 3 wherein said basin is shaped by bending it with a tool simulating the bottom of a lighter in order to vertically align said lighter.

* * * * *